US006700466B1

(12) United States Patent
Yamamoto et al.

(10) Patent No.: US 6,700,466 B1
(45) Date of Patent: Mar. 2, 2004

(54) CONTACTOR

(75) Inventors: Ritsu Yamamoto, Kadoma (JP); Tsutomu Shimomura, Kadoma (JP); Riichi Uotome, Kadoma (JP); Hideki Enomoto, Kadoma (JP); Takehiko Toguchi, Kadoma (JP); Mamoru Tateno, Kadoma (JP); Yoshiyuki Iwami, Obihiro (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/868,036

(22) PCT Filed: Oct. 13, 2000

(86) PCT No.: PCT/JP00/07149

§ 371 (c)(1),
(2), (4) Date: Jul. 17, 2001

(87) PCT Pub. No.: WO01/27950

PCT Pub. Date: Apr. 19, 2001

(30) Foreign Application Priority Data

Oct. 14, 1999 (JP) ..... 11/292699
Oct. 14, 1999 (JP) ..... 11/292700

(51) Int. Cl.[7] ..... H01H 67/02
(52) U.S. Cl. ..... 335/132; 218/156; 335/201
(58) Field of Search ..... 335/6, 10, 147, 335/195, 132, 202, 201; 218/153–6

(56) References Cited

U.S. PATENT DOCUMENTS 5,004,874 A * 4/1991 Theisen et al. ..... 218/155
5,546,061 A * 8/1996 Okabayashi et al. ..... 335/78

FOREIGN PATENT DOCUMENTS

| | | |
|---|---|---|
| GB | 2058463 | * 10/1979 |
| JP | 52-101476 | 8/1977 |
| JP | 61-179623 | 8/1986 |
| JP | 7-320606 | 12/1995 |
| JP | 7-320624 | 12/1995 |
| JP | 8-45411 | 2/1996 |
| JP | 10-144171 | 5/1998 |
| JP | 10-154458 | 6/1998 |

* cited by examiner

*Primary Examiner*—Lincoln N. Donovan
(74) *Attorney, Agent, or Firm*—Oblon, Spivak, McClelland, Maier & Neustadt, P.C.

(57) ABSTRACT

A contact apparatus is provided having a permanent magnet disposed in a region where a fixing contact point is mounted to a fixing contact and a movable contact to which a movable contact point is mounted. An arc generated between both the contact points is moved in a lateral direction by the magnetic force of the permanent magnet and stretched. An arc-extinguishing member which is heated by the arc for generating arc-extinguishing gas is provided such as to surround the fixing contact point and the movable contact point.

16 Claims, 9 Drawing Sheets

CONTACTOR

This application is a U.S. national phase application of PCT International Application PCT/JP00/07149.

TECHNICAL FIELD

The present invention relates to a contact apparatus suitable for a relay of a power load or an electromagnetic switch.

BACKGROUND OF THE INVENTION

Background Technique

In a contact apparatus used for opening and closing a power supply of an electrically running automobile, relatively great DC current as great as 100A is switched. In such a contact apparatus, it is difficult to swiftly break the current due to arc generated between contacts when an electric path is opened. Thereupon, Japanese Patent Application Laid-Open No. H8-45411 for example discloses a contact apparatus having an insulator which is heated by heat of an arc for generating arc-extinguishing gas, in which the arc is cooled by the arc-extinguishing gas, thereby enhancing the breaking performance.

However, if the insulator for generating the arc-extinguishing gas is merely provided, a voltage rising speed of the arc generated between contacts is small, and there is a problem that excellent breaking performance can not always be obtained.

The present invention has been accomplished in view of the above problem, and it is an object of the invention to provide a contact apparatus in which a voltage rise of an arc generated between contacts is abruptly generated to enhance the breaking performance of an electric path.

BRIEF SUMMARY OF THE INVENTION

Disclosure of the Invention

A contact apparatus of the present invention comprises a fixed contact having a fixed contact point, a movable contact provided with a movable contact point which is connected to and separated from the fixed contact point, and a driving mechanism for driving the movable contact, wherein a permanent magnet is disposed in a vicinity of a region where the fixed contact point and the movable contact point are located, an arc generated when the fixed contact point and the movable contact point are separated from each other is formed so that arc is moved sideways from the opposed region between the fixed contact point and the movable contact point by magnetic force of the permanent magnet and the arc is stretched.

In the contact apparatus of such a structure, the arc generated between the fixing contact point and the movable contact point when the electric path is opened is moved sideways by the magnetic force of the permanent magnet and stretched. The arc length is increased and thus, the arc voltage rises. With this, the arc is swiftly extinguished, and the breaking performance of the electric path is enhanced.

In addition to the above, if an arc-extinguishing member made of insulative material capable of generating arc-extinguishing gas is provided in a region near the fixed contact point and the movable contact point, the arc is cooled by the arc-extinguishing gas. With this, the arc voltage further rises, the breaking performance of the electric path is further enhanced.

The above and other objects and features of the present invention will be clearer from the following explanation of embodiments with reference to the accompanying drawings.

DETAILED DESCRIPTION OF THE INVENTION

Best Mode for Carrying out the Invention

Embodiment 1

Figure 1:
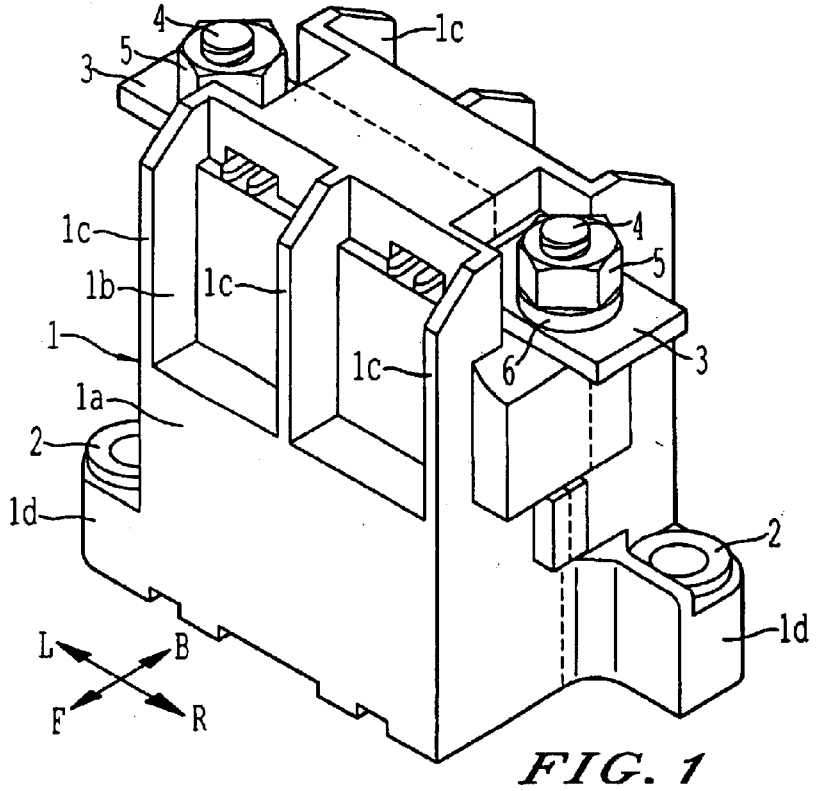
FIG. 1 is a perspective view showing an outward appearance of a contact apparatus in an embodiment 1 of the present invention.

A contact apparatus according to this embodiment includes a housing 1 of an outward appearance shown in FIG. 1. The housing 1 comprises synthetic resin molded product. A lower half of the housing 1 is formed as a substantially rectangular parallelepiped lower housing portion 1*a* for accommodating a driving mechanism 13 therein, and an upper half is formed as an upper housing portion 1*b* for accommodating a current switching mechanism 11 which will be described later. A longitudinal thickness (in an F-B direction in the drawing) of the upper housing portion 1*b* is smaller than that of the lower housing portion 1*a*. Vertical wall-like ribs 1*c* . . . are formed on opposite ends and an intermediate portion in the lateral direction (in an L-R direction in the drawing) of front and rear wall surfaces of the upper housing portion 1*b*.

Fixing portions 1*d* and 1*d* are formed on a bottom of the lower housing portion 1*a* for fixing the contact apparatus. The fixing portions 1*d* and 1*d* project sideways (L-R direction) from left and right side walls. Metal sleeves 2 and 2 are press-fitted into centers of the fixing portions 1*d* and 1*d*. The contact apparatus is fixed by inserting and fastening fixing tools such as bolts (not shown) into the sleeves 2 and 2.

A pair of fixing contacts 3 and 3 made of copper materials are assembled into an upper end of the upper housing portion 1*b* such as to project sideways from left and right side walls of the upper housing portion 1*b*. A bolt 4, a nut 5 and a spring washer 6 are mounted to an end of each of the fixing contacts 3 and 3. Using these members 4 to 6, connection terminals provided on ends of an external electric wiring (not shown) are fixed and connected to the fixing contacts 3 and 3.

Figure 2:
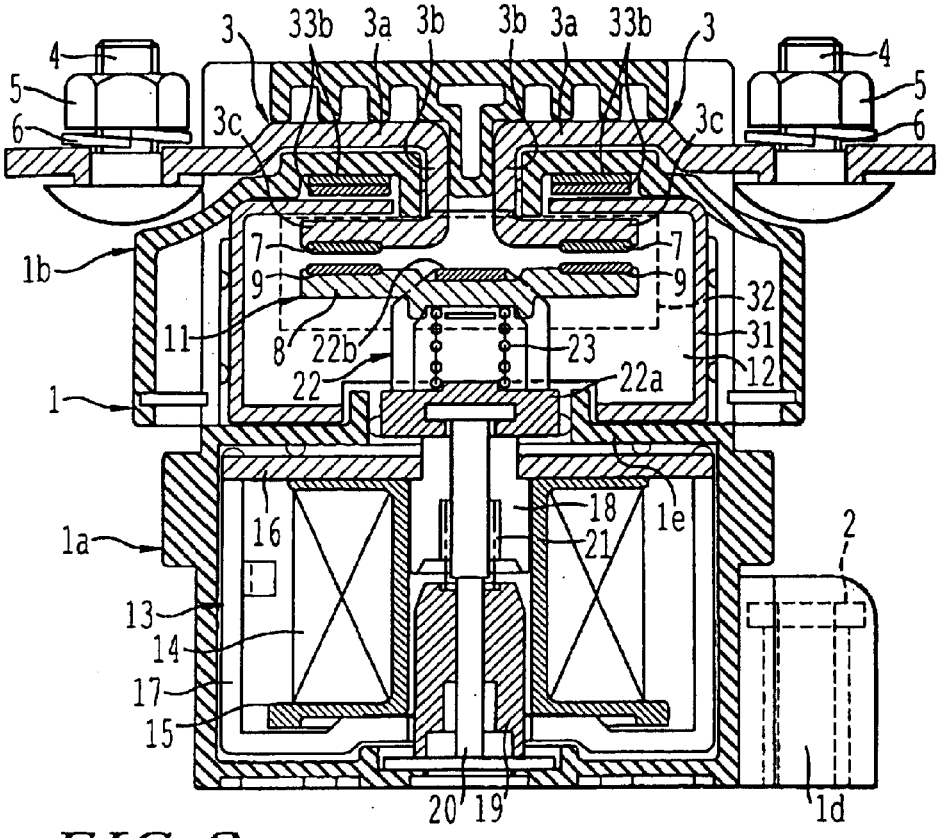
FIG. 2 is a front sectional view of the contact apparatus.

As shown in FIG. 2, a portion of each the fixing contact 3 located in the housing 1 has substantially U-shaped section having terminal connection portions 3*a* extending outward substantially horizontally from centers of left and right sides of the housing 1, connection portions 3*b* bent downward from inner ends of the terminal connection portions 3*a*, and contact fixing portions 3*c* extending horizontally sideways from lower ends of the connection portions 3*b*. The terminal connection portions 3*a* project sideways from inside of the housing 1, and the bolts 4, the nuts 5 and the spring washers 6 are mounted to outer ends of the terminal connection portions 3*a*. Fixing contact points 7 and 7 made of silver are jointed to lower surfaces of the contact fixing portions 3*c* and 3*c* at locations thereof closer to the ends thereof by brazing.

A movable contact 8 made of copper plate is disposed below each of the contact fixing portions 3*c* and 3*c*. The movable contact 8 has a length for entirely covering the pair of left and right contact fixing portions 3*c* and 3*c*. The movable contact 8 is provided by brazing at its left and right opposite ends with movable contact points 9 and 9 made of silver.

When the movable contact 8 is driven upward by the driving mechanism 13 from the position shown in the drawing, both the movable contact points 9 and 9 abut against the fixing contact points 7 and 7 from below. With this movement, the pair of left and right fixing contacts 3 and 3 are brought into conduction through the movable contact 8. That is, a current path (which is also called electric path) between both the fixing contacts 3 and 3 is switched by the vertical movement of the movable contact 8. The fixing contacts 3 and 3 and the movable contact 8 constitute a current switching mechanism 11. This current switching mechanism 11 is disposed in the upper housing portion 1*b*. The current switching mechanism 11 has a space for accommodating the fixing contacts 3 and 3, the contact fixing portions 3*c* and 3*c* and the movable contact 8. This space is formed as a current switching chamber 12.

The driving mechanism 13 comprising an electromagnet is accommodated in the lower housing portion 1*a*. The driving mechanism 13 comprises a coil bobbin 15 around which a coil 14 is wound, an upper yoke 16 disposed along an upper surface of the coil bobbin 15, and a lower yoke 17 for surrounding an outside of the coil bobbin 15 from a lower surface of the coil bobbin 15. The lower yoke 17 has a substantially U-shaped section. The coil bobbin 15, the upper yoke 16 and the lower yoke 17 are provided at their central portion with a through hole, a fixing core 18 is fixed to upper portion thereof, and a movable core 19 is disposed below the fixing core 18. A driving shaft 20 passing through the fixing core 18 and extending upward is mounted to the movable core 19. Further, a return spring 21 comprising a compression coil spring is disposed between the fixing core 18 and the movable core 19.

The housing 1 is provided with a substantially horizontal first partition wall 1*e* for partitioning the space of the driving mechanism 13 from the upper current switching chamber 12. A synthetic resin connection portion 22 projecting upward is disposed in a position in the center through hole of the first partition wall 1*e*. An upper end of the driving shaft 20 is engaged with a lower wall surface 22*a* of the connection portion 22. With this arrangement, the connection portion 22 is vertically moved in unison with the driving shaft 20.

The movable contact 8 passes through the connection portion 22 horizontally and is assembled to the connection portion 22. In more detail, a contact pressure spring 23 comprising a compression coil spring is further provided in the connection portion 22. The movable contact 8 is held by the connection portion 22 in a state in which a center region of the movable contact 8 is pushed against an upper wall surface 22*b* of the connection portion 22 by this spring 23.

With this structure, the movable core 19 is absorbed by the fixing core 18 and moved upward if the coil 14 is brought into conduction and the coil 14 is excited. The driving shaft 20, the connection portion 22 and the movable contact 8 are moved upward in unison with the movable core 19. As a result, the pair of left and right movable contact points 9 and 9 abut against the fixing contact points 7 and 7 of the fixing contacts 3 and 3, and the electric path between the fixing contacts 3 and 3 is closed. From this state, if the conduction of the coil 14 is stopped, the movable core 19 is moved downward by spring force of the contact pressure spring 23 and the return spring 21. As a result, the movable contact 8 is also moved downward and the movable contact points 9 and 9 are separated from the fixing contact points 7 and 7, the non-conductive state between the fixing contacts 3 and 3 is switched, and the electric path is opened.

When the movable contact points 9 and 9 are separated from the fixing contact points 7 and 7, an arc is generated between the contacts 9 and 7. In order to swiftly extinguish the arc to enhance the breaking performance of the electric path, in the contact apparatus of this embodiment, an arc-extinguishing member 31 and a permanent magnet 32 are further incorporated in the upper housing portion 1*b* as will be explained below.

Figure 3A:
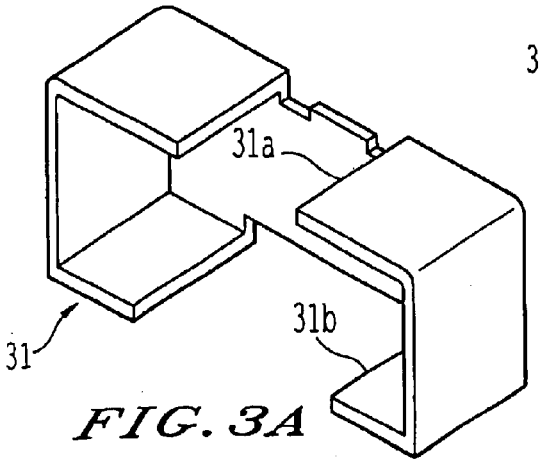
FIGS. 3 show an arc-extinguishing member incorporated in the contact apparatus, wherein FIG. 3(*a*) is a perspective view, and FIG. 3(*b*) is a perspective view showing a positional relation between the arc-extinguishing member, a fixing contact and a movable contact.
Figure 3B:
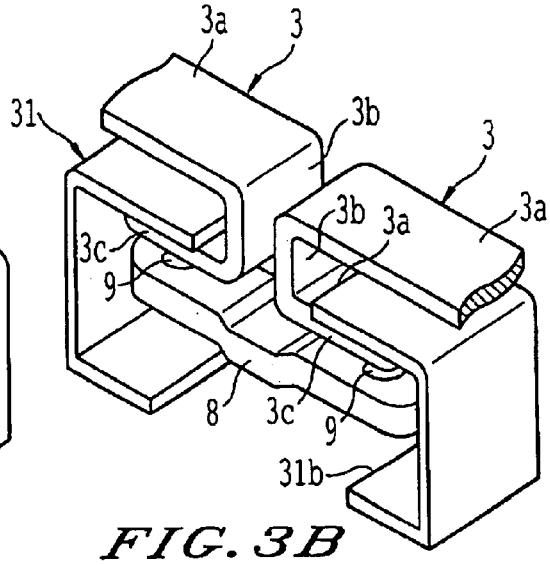

As shown in FIG. 3(*a*), the arc-extinguishing member 31 is formed into a rectangular parallelepiped box-like shape. In this drawing, a lid for covering a front surface is omitted. Notched openings 31*a* and 31*b* are formed in central regions of upper and lower surfaces of the arc-extinguishing member 31. As shown in FIG. 3(*b*), the arc-extinguishing member 31 is mounted in the upper housing portion 1*b* such as to surround the contact fixing portions 3*c* and 3*c* of the fixing contacts 3 and 3 and the movable contact 8. The notched opening 31*a* of the upper surface of the arc-extinguishing member 31 has such a width that terminal connection portions 3*a* and 3*a* of the fixing contacts 3 and 3 can be inserted. The lower notched opening 31*b* of the lower surface has such a width that the connection portion 22 can be inserted.

The arc-extinguishing member 31 is made of insulative material capable of generating arc-extinguishing gas. As described above, if the arc is generated when the movable contact point 9 is separated from the fixing contact point 7, the arc and its periphery is heated to a high temperature. As the arc is heated, the arc-extinguishing gas is generated from the arc-extinguishing member 31, and the arc is cooled by this gas. As a result, the arc voltage rises, the arc is extinguished swiftly, and the breaking performance is enhanced.

As the insulative material capable of generating the arc-extinguishing gas, unsaturated polyester or chain compound to which metal hydroxide or hydrate is added is preferable. As the chain compound, nylon 6 or nylon 66 is preferable. As the metal hydroxide, magnesium hydroxide is preferable. By using such materials, it is possible to enhance insulative pressure-resistance deterioration characteristics.

Figure 4A:
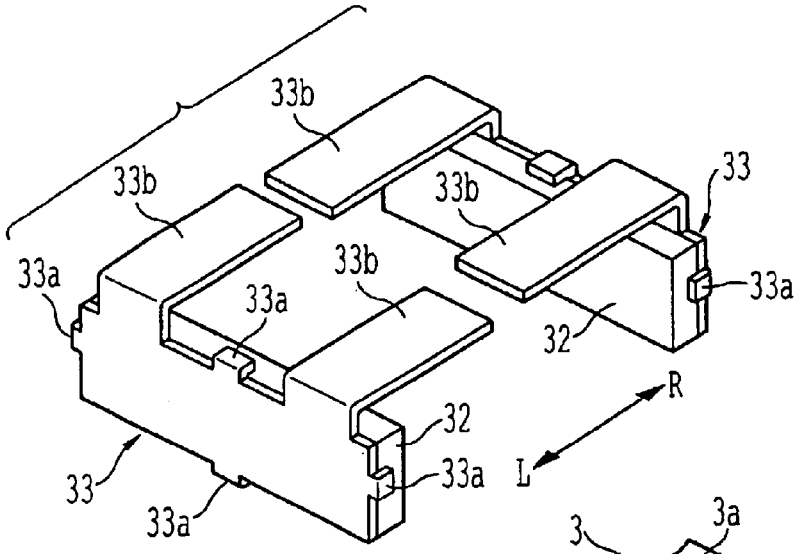
FIGS. 4 show a pair of permanent magnets incorporated in the contact apparatus, wherein FIG. 4(*a*) is a perspective view, and FIG. 4(*b*) is a perspective view showing a positional relation between the permanent magnets and the arc-extinguishing member.
Figure 4B:
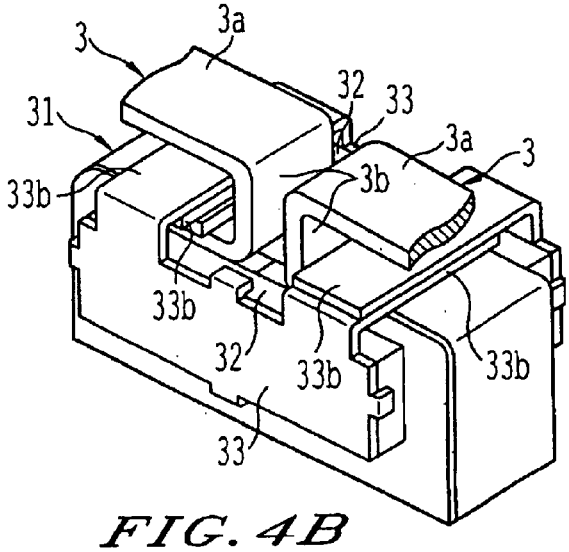

FIG. 4(*a*) shows a pair of permanent magnets 32 and 32 further incorporated in the upper housing portion 1*b*. Each of the permanent magnets 32 and 32 is formed into a rectangular parallelepiped plate-like shape. The permanent magnets 32 and 32 are disposed such as to be opposed to each other in the longitudinal direction (in the F-R direction in the drawing) such as to sandwich the arc-extinguishing member 31. The permanent magnets 32 and 32 are provided at their back surfaces with yokes 33 and 33 made of metal plates for covering the entire surfaces thereof. The yokes 33 and 33 are provided at their peripheries with short projections 33*a* . . . projecting along peripheral surface of the permanent magnets 32 and 32.

By fitting the permanent magnets 32 between the projections 33*a* . . . relative mounting positions between the permanent magnets 32 and 32 and the yokes 33 and 33 are held. Further, the yokes 33 and 33 are provided at their upper edges with magnetic path forming portions 33*b* . . . projecting in the longitudinal direction beyond the thickness size of the permanent magnets 32 and 32. Therefore, each of the yokes 33 and 33 is formed into substantially L-shaped in section at a region of the magnetic path forming portion 33*b*.

The yoke 33 having the above shape can be mounted to the permanent magnet 32 using adhesive, but in this embodiment, the yoke 33 is absorbed and held by the permanent magnet 32 using magnetic force of the permanent magnet 32. Therefore, in this case, since adhering operation is unnecessary, it is possible to extremely easily assemble the apparatus.

As shown in FIG. 4(*b*), the permanent magnets 32 and 32, to which the yokes 33 and 33 are mounted, are incorporated in the upper housing portion 1*b* such that they are located at positions along a front surface lid and a rear surface wall of the box-like arc-extinguishing member 31, respectively. At that time, the magnetic path forming portion 33*b* of the yoke 33 on the front surface side and the magnetic path forming portion 33*b* on the rear surface side are superposed on each other and assembled. With this design, the front and rear permanent magnets 32 and 32 are magnetically mutually connected through the magnetic path forming portions 33*b* and 33*b* which are superposed vertically. As shown in FIG. 2, the magnetic path forming portions 33*b* pass between the terminal connection portion 3*a* and the contact fixing portion 3*c* of each of the fixing contacts 3 and 3, i.e., through the U-shaped portion in the longitudinal direction.

Figure 5:
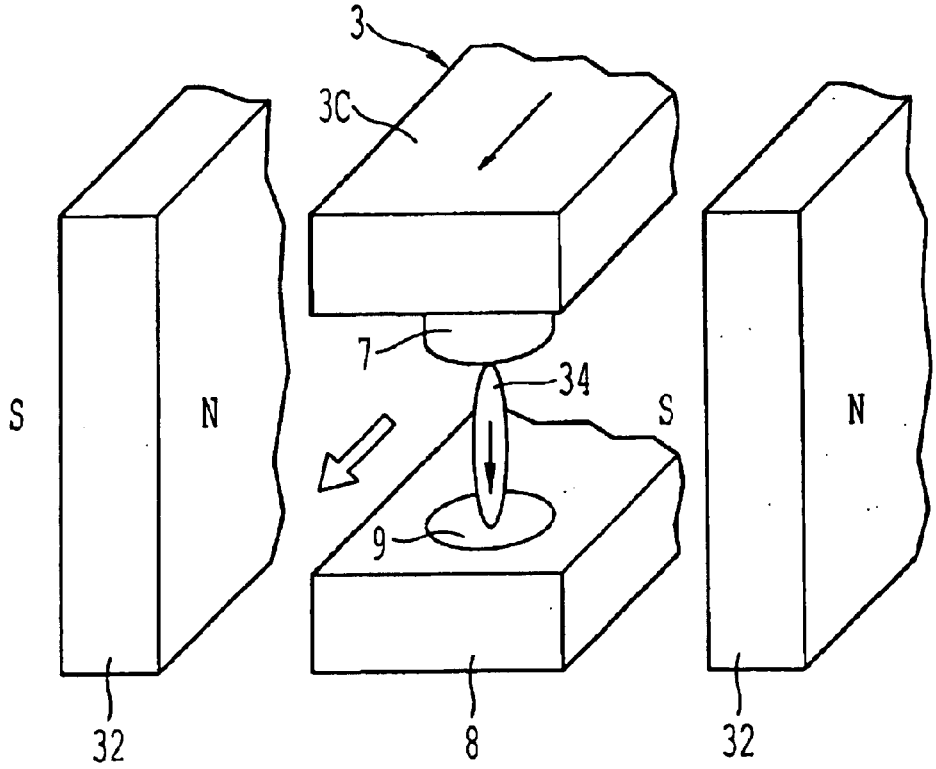
FIG. 5 is a schematic view of an essential portion showing an action of the permanent magnets.

As shown in FIG. 5, the permanent magnets 32 and 32 are magnetized such that one of surfaces of the permanent magnets 32 and 32 opposed to each other while sandwiching the accommodating space for the fixing contact point 7 and the movable contact point 9 is the north pole, and the other surface is the south pole. In the contact apparatus of the embodiment, it is assumed that DC current is allowed to flow between both the fixing contacts 3 and 3 through the movable contact 8. In this case, a direction of the current is determined in a constant direction. When this direction is shown with a solid arrow, the permanent magnets 32 and 32 are formed such that when the electric path is opened and the arc 34 is generated between the contact points 7 and 9, magnetic action for moving the arc in a direction toward ends of the fixing contact 3 and the movable contact 8 is generated in the arc 34.

Figure 6:
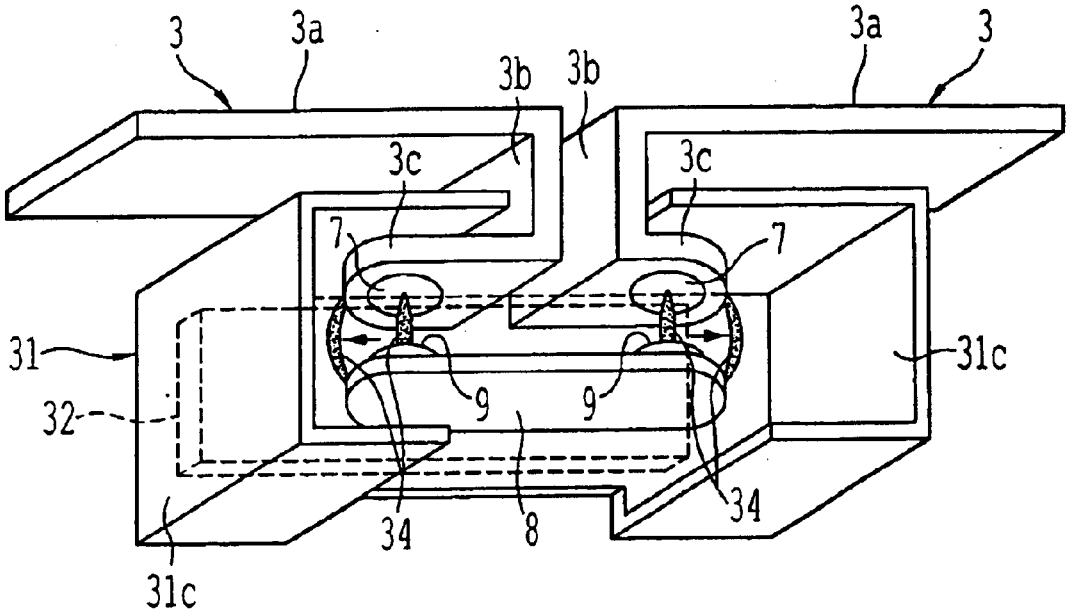
FIG. 6 is a schematic view of an essential portion showing an operation state of the arc generated by the action of the permanent magnets.

With this structure, if the arc 34 moved to the ends of the fixing contact 3 and the movable contact 8, as shown in FIG. 6, since the above magnetic force is also applied, the arc 34 is stretched to draw a curve. In this contact apparatus, since the DC current is switched, the direction of the current flowing through the left and right arcs 34 and 34 are vertically opposite. Therefore, the left and right arcs 34 and 34 are simultaneously moved toward the opposite ends of the fixing contacts 3 and 3 and the movable contact 8 and stretched.

Since the arc 34 is stretched, the arc voltage rises. The arc 34 is cooled also by the arc-extinguishing gas generated from the arc-extinguishing member 31, the arc voltage further rises. As a result, the arc is swiftly extinguished, and current break is carried out at high speed.

Figure 7:
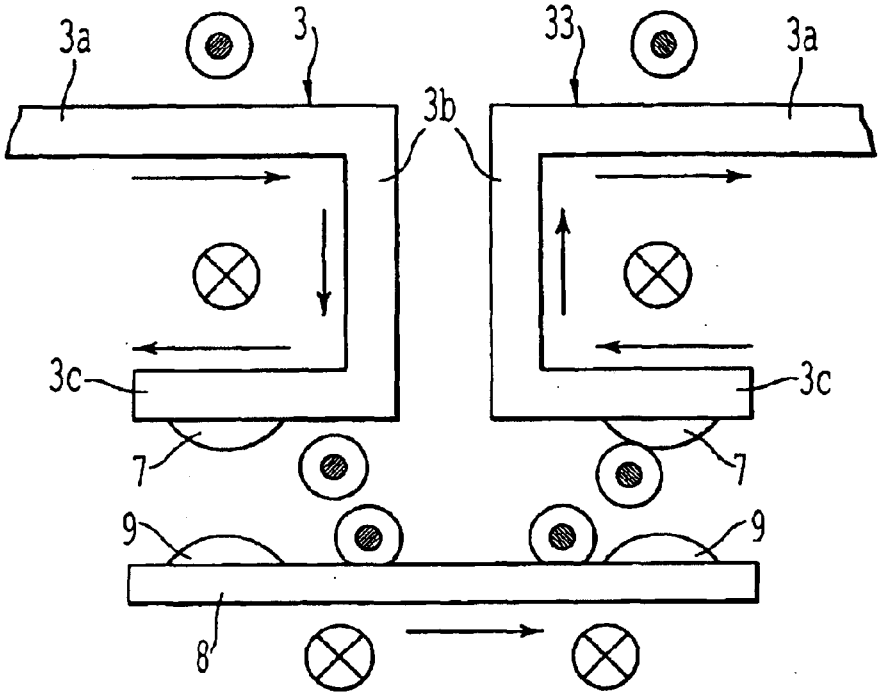
FIG. 7 is a schematic sectional view of an essential portion showing magnetic action generated by current flowing through the fixing contact and the movable contact.

Each of the fixing contacts 3 and 3 in this embodiment is formed into the substantially U-shaped as described above. With this design, as shown in FIG. 7, directions (direction of→) of current flowing through the contact fixing portions 3*c* and 3*c* of the fixing contacts 3 and 3 and the movable contact point 9 are in parallel and opposite from each other. Therefore, magnetic field generated in accordance with the direction of the current is strengthened and applied to the arc 34 generated between the contact points 7 and 9. As a result, the arc 34 swiftly moves the contact fixing portions 3*c* and 3*c* and the movable contact point 9 toward the ends. Therefore, with this design also, the breaking characteristic of the electric path is further enhanced.

Figure 8:
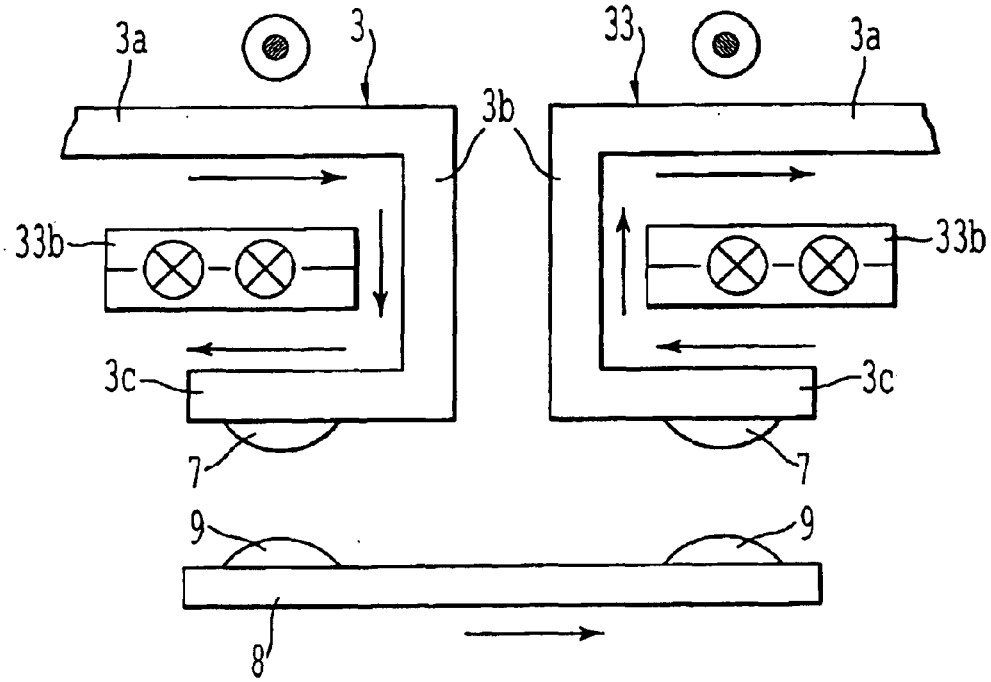
FIG. 8 is a schematic sectional view of an essential portion showing a relation between yoke and current flowing through the fixing contact.

In this embodiment, the magnetic path forming portions 33*b* of the yoke 33 mounted to the permanent magnets 32 and 32 pass through the U-shaped portions of the fixing contacts 3 and 3 and are positioned. With this design, as shown in FIG. 8, magnetic flux generated from current (current flowing through the terminal connection portion 3*a* of the fixing contact 3) flowing in the same direction as the movable contact 8 of the current flowing through the fixing contact 3 is absorbed by the magnetic path forming portion 33*b* of the yoke 33. As a result, magnetic flux applied between the contact points 7 and 9 is increased, the arc 34 generated between the contact points 7 and 9 swiftly moves toward the end. Therefore, with this design also, the breaking performance of the electric path is further enhanced.

As explained with reference to FIG. 6, the arc 34 generated between the contact points 7 and 9 moves toward the ends of the terminal connection portion 3*a* of the fixed contact and the movable contact 8, and are curved sideways and stretched. A side wall surface 31*c* of the arc-extinguishing member 31 located in the moving direction of the arc 32 can be provided with a plurality of slits 31*d* . . . as shown in FIG. 9(*a*).

Figure 9A:
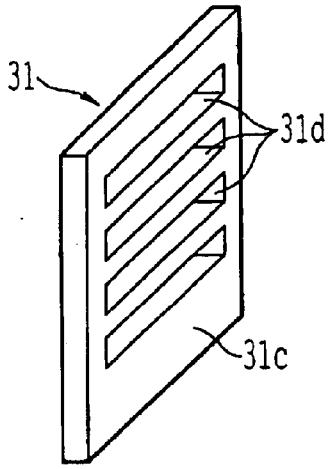
FIGS. 9 show a modification of the arc-extinguishing member, wherein FIG. 9(*a*) is a partial perspective view, and FIG. 9(*b*) is a schematic sectional view of an essential portion showing a relation between the arc-extinguishing member and the arc.
Figure 9B:
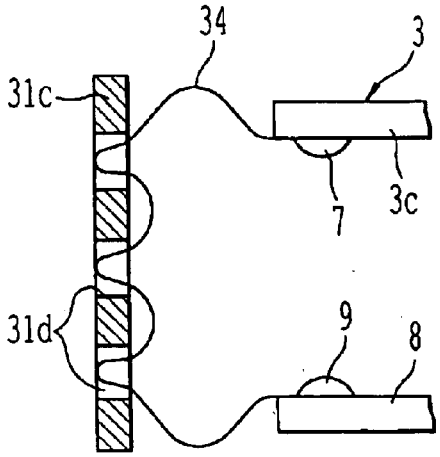

With this structure, as shown in FIG. 9(*b*), the arc 34 swelling toward the side wall surface 31*c* further swells into the slits 31*d*. Thus, the arc length is further extended, the arc voltage is increased, and the breaking performance is further enhanced.

Figure 10A:
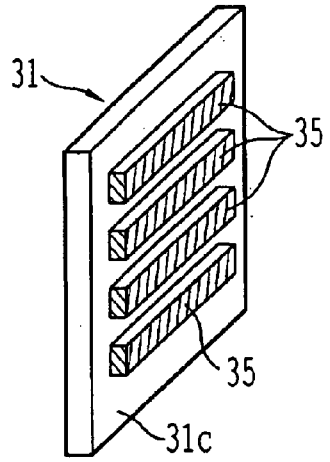
FIGS. 10 show another modification of the arc-extinguishing member, wherein FIG. 10(*a*) is a partial perspective view, FIG. 10(*b*) is a schematic sectional view of an essential portion showing a relation between the arc-extinguishing member and the arc, and FIG. 10(*c*) is a view showing characteristics of arc voltage in a state shown in FIG. 10(*b*)
Figure 10B:
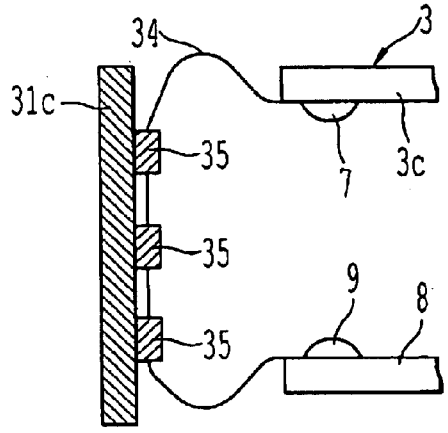
Figure 10C:
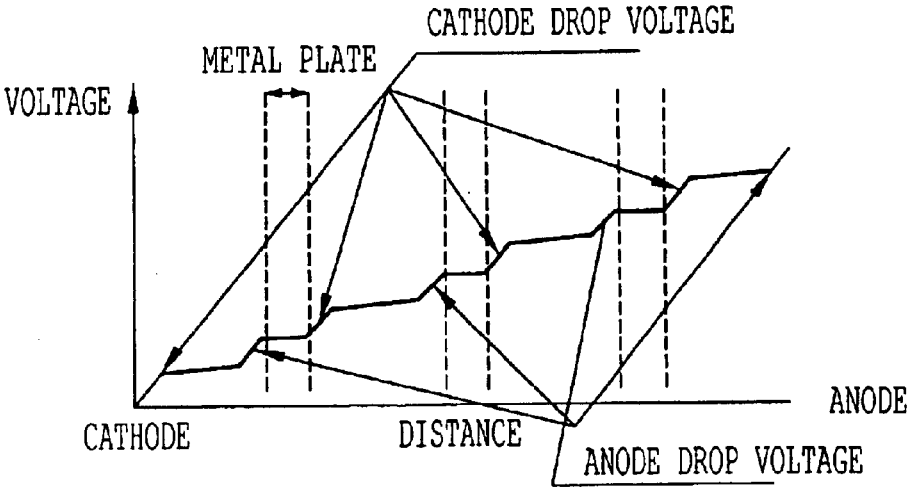

As shown in FIG. 10(*a*), a plurality of metal plates 35 . . . may be mounted to the side wall surface 31*c* of the arc-extinguishing member 31 by a method such as integral forming. With this structure, as shown in FIG. 10(*b*), the arc 34 pumps and moves to the metal plates 35 . . . . As shown in FIG. 10(*c*), the arc voltage rises by a value corresponding to cathode drop voltage and anode drop voltage generated in each metal plate 35. With this feature also, the breaking performance of the electric path can further be enhanced.

Figure 11:
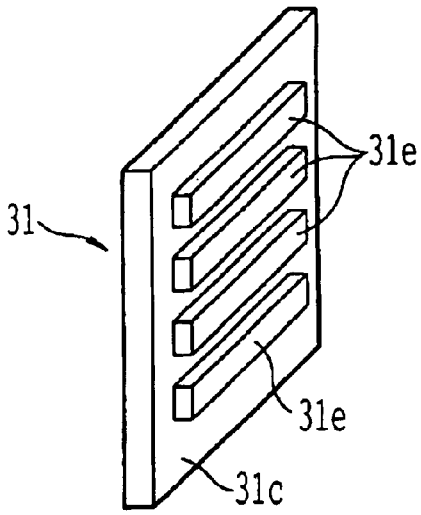
FIG. 11 is a partial perspective view showing another modification of the arc-extinguishing member.

As shown in FIG. 11, the side wall surface 31*c* of the arc-extinguishing member 31 may be provided with a plurality of projections 31*e*. With this structure, since the surface area of the arc-extinguishing member 31 receiving heat of the arc 34 is increased, the amount of the arc-extinguishing gas generated is increase, which also enhance the breaking performance of the electric path.

Embodiment 2

Figure 12:
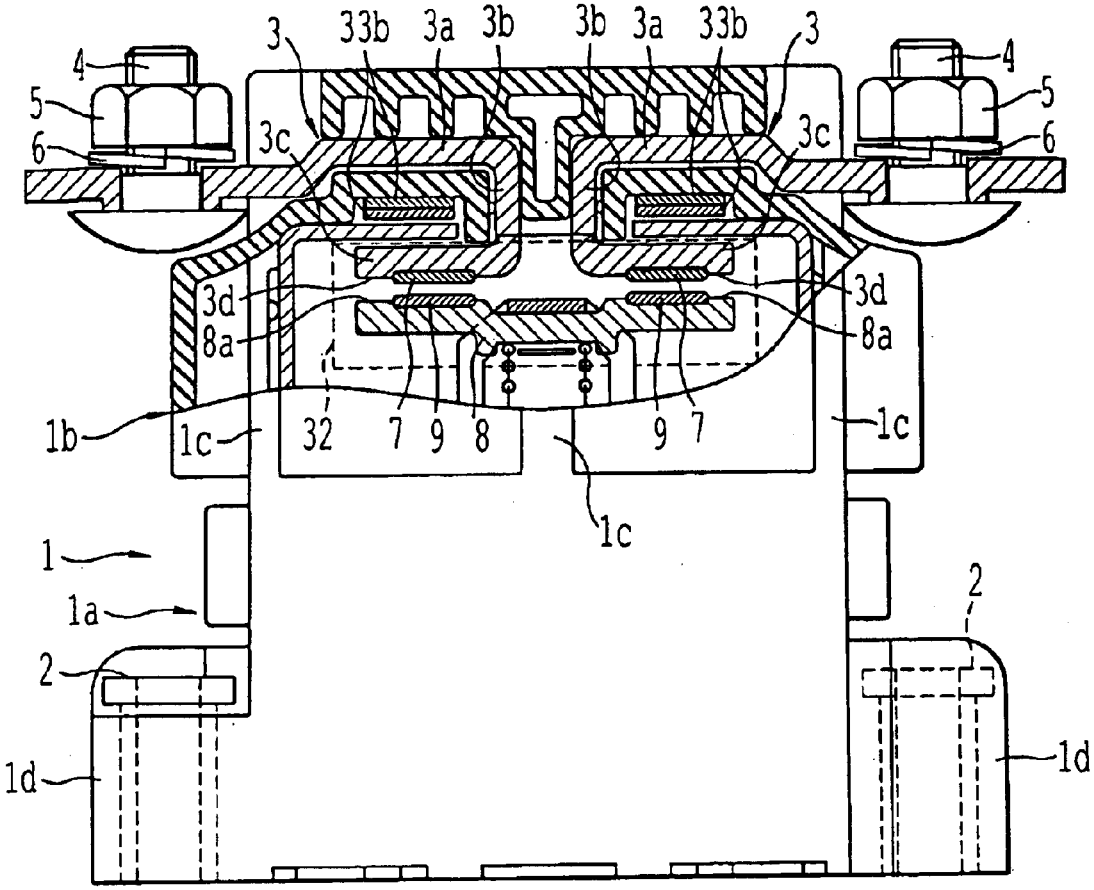
FIG. 12 is a partially cut-off front sectional view of a contact apparatus according to an embodiment 2 of the invention.

A contact apparatus according to another embodiment of the present invention will be explained with reference to FIG. 12. Members having the same functions as those of the contact apparatus of the previous embodiment 1 are designated with the same symbols, and detailed explanation thereof is omitted. The same is applied to the subsequent embodiments.

In this contact apparatus of the present embodiment, the pair of left and right fixing contact points 7 and 7 and the movable contact points 9 and 9 which are opposed to the former contacts from below are provided at locations closer to a center line of the housing 1 compared to that of the previous embodiment 1. With this structure, a length of each the contact fixing portion 3*c* from the fixing contact point 7 to the end is long, and this portion is formed as an arc running portion 3*d*. Similarly, the movable contact 8 is provided at outer sides from the mounted positions of the movable contact points 9 and 9 with long arc running portions 8*a* and 8*a*.

In the contact apparatus of such a structure, the arc generated between the contact points 7 and 9 moves sideways on the arc running portion 3*d* and 8*a* by the magnetic force of the permanent magnet 32 and then, the arc is curved from the end and stretched. As explained with reference to FIG. 7, magnetic field generated by current flowing through the contact fixing portions 3*c* and 3*c* of the fixing contacts 3 and 3 and the movable contact point 9 is added to the movement on the arc running portions 3*d* and 8*a*, and as explained with reference to FIG. 8, the magnetic flux generated from the current flowing through the terminal connection portion 3*a* of the fixing contact 3 is absorbed by the magnetic path forming portion 33*b* of the yoke 33, and the magnetic flux between the contact points 7 and 9 is increased, the arc is generated within an extremely short time and reaches the end immediately and is stretched as described above.

A distance between the arc and the contact points 7 and 9 at that position becomes long in accordance with the length of the arc running portions 3*d* and 8*a*. Therefore, the contact points 7 and 9 are prevented from being heated to a high temperature by heat of the arc. As a result, the breaking performance of the electric path is enhanced like the previous embodiment, and even of the switching of the electric path is repeated, a wear amount of the contact points 7 and 9 caused by the switching is reduced, and the life of the contact is enhanced.

Embodiment 3

A contact apparatus of another embodiment of the present invention will be explained with reference to FIGS. 13 to 16.

Figure 13:
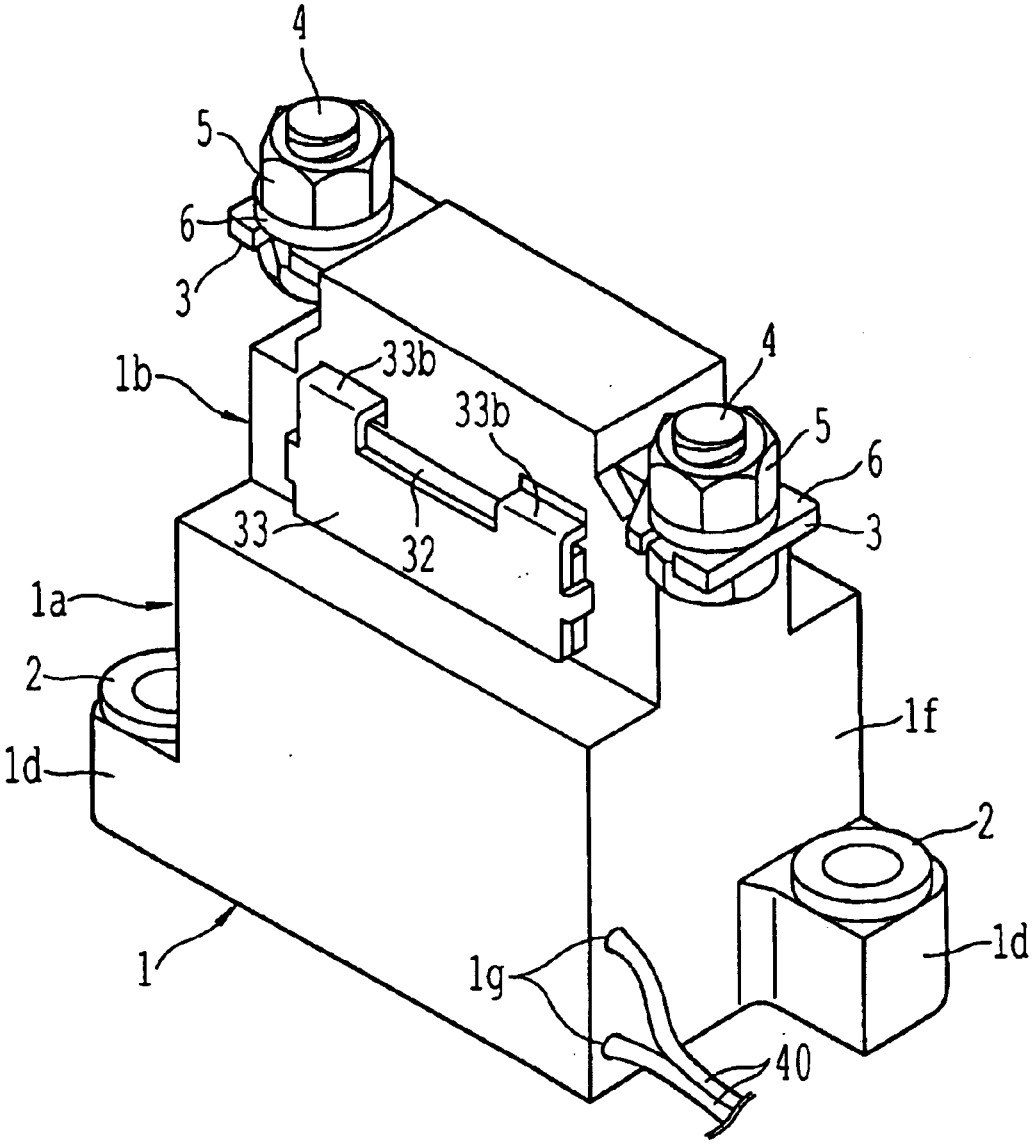
FIG. 13 is a perspective view showing an outer appearance of a contact apparatus in an embodiment 3 of the invention.

As shown in FIG. 13, the housing 1 of this contact apparatus comprises the lower housing portion 1*a* and the upper housing portion 1*b* provided on the lower housing portion 1*a*. The upper housing portion 1*b* has a thickness in the longitudinal direction smaller than that of the lower housing portion 1*a*. However, the front and rear wall surfaces of the upper housing portion 1*b* are not provided with the ribs 1*c* . . . shown in FIG. 1, but are formed as flat surfaces. The permanent magnet 32 having the yoke 33 having the same shape as that of the previous embodiment is mounted to each of the surfaces from outside. That is, the upper housing portion 1*b* is formed with through holes in the longitudinal direction, and the magnetic path 33*b* of the yoke 33 passes through each of the through holes, and the pair of permanent magnets 32 and 32 are mounted to the upper housing portion 1*b* from front and back.

In FIG. 13, a reference number 40 represents a lead wire to be electrically connected to the coil 14. The lead wire 40 is pulled out through an outlet hole 1*g* formed in an outer wall if of a side of the lower housing portion 1*a*.

Figure 14:
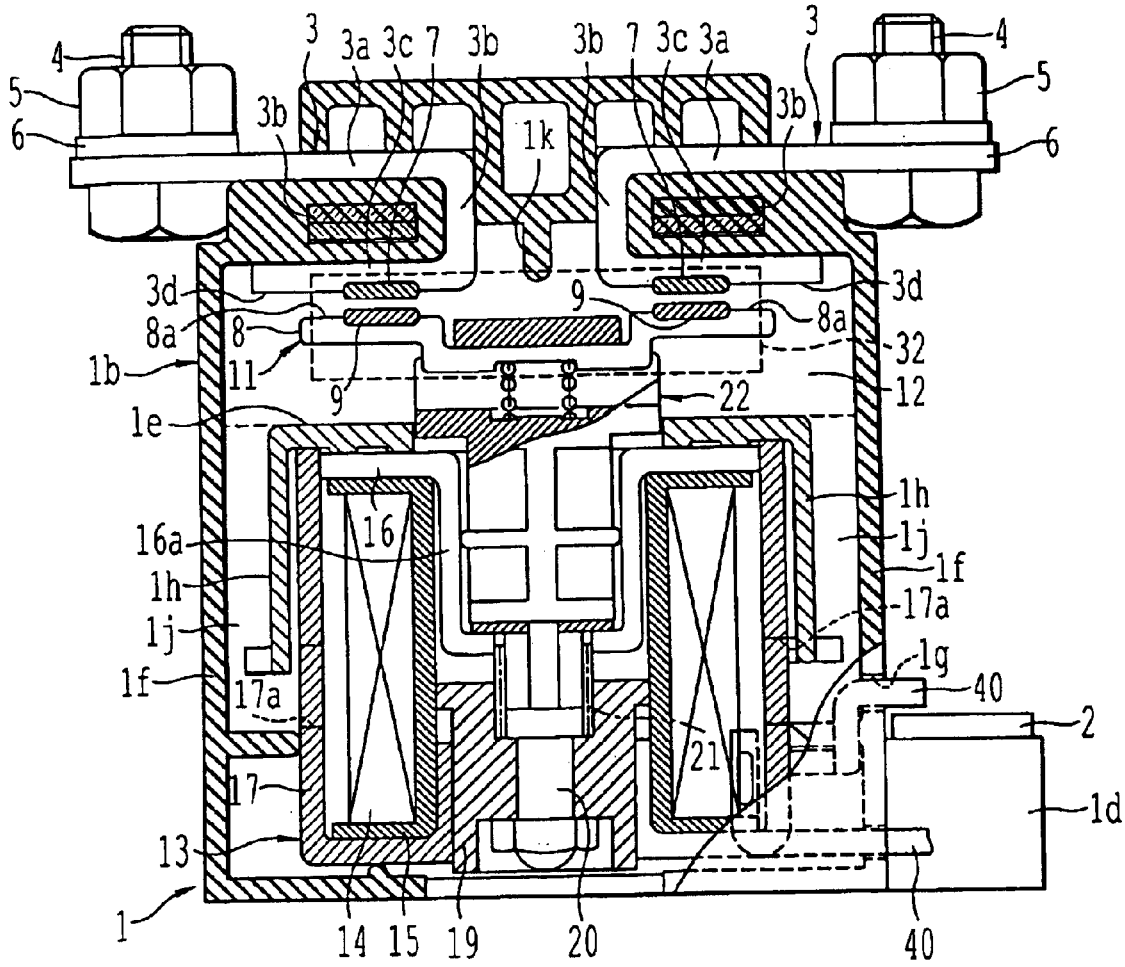
FIG. 14 is a front sectional view of the contact apparatus shown in FIG. 13.

As shown in FIG. 14, the driving mechanism 13 comprising a electromagnetic apparatus having substantially the same structure as that of the embodiment 1 is accommodated in the lower housing portion 1*a*. However, in this driving mechanism 13, a cylinder 16*a* suspended downward in a cylindrical shape into a center region in the upper yoke 16 is formed. This cylinder 16*a* functions in the same manner as that of the fixing core 18 shown in FIG. 2. In this driving mechanism 13, the driving shaft 20 fixed at its lower end to the movable core 19 and extending upward, and the connection portion 22 for holding the movable contact 8 are integrally formed by synthetic resin.

A lateral length of a first partition wall 1*e* for partitioning the driving mechanism 13 from the current switching chamber 12 is set shorter than a size between the outer walls 1*f* and 1*f* so that a space is formed between the left and right outer wall 1*f* and 1*f*. The housing 1 is further provided with second partition walls 1*h* and 1*h* suspending downward from left and right opposite ends of the first partition wall 1*e*. The driving mechanism 13 is disposed between the second partition walls 1*h* and 1*h*. Vent passages 1*j* and 1*j* which are in communication with the current switching chamber 12 are formed between the second partition walls 1*h* and 1*h* and the left and right opposite side outer wall 1*f* and 1*f* of the housing 1.

The lower yoke 17 is formed with notched openings 17*a* and 17*a* at height positions corresponding to lower ends of the second partition walls 1*h* and 1*h*. Therefore, The vent passages 1*j* and 1*j* are in communication also with the space of the driving mechanism 13 through the notched openings 17*a* and 17*a*. A right outer wall if of the housing 1 is formed with an outlet hole 1*g* for pulling out the lead wire 40. The vent passage 1*j* is in communication with outside through the outlet hole 1*g*.

In the upper housing portion 1*b*, the pair of fixing contacts 3 and 3 and the movable contact 8 formed in substantially the same manner as those in the previous embodiment are disposed. In the current switching chamber 12 in which these members are disposed, the arc-extinguishing member 31 is not disposed. Instead, the housing 1 itself is made of material which generates the arc-extinguishing gas such as nylon 6 or nylon 66 to which magnesium hydroxide is added, PBT or unsaturated polyester.

The contact fixing portions 3*c* and 3*c* of the fixing contacts 3 and 3 and the movable contact 8 are provided with arc running portions 3*d*, 3*d*, 8*a* and 8*a* extending laterally from mounted positions of the fixing contact points 7 and 7 and the movable contact points 9 and 9 in the same manner as that of the previous embodiment. A length of each of the arc running portions 3*d* and 3*d* of the contact fixing portion 3*c* and 3*c* is set longer than the arc running portion 8*a* and 8*a* of the movable contact 8.

In the housing 1 of the contact apparatus of this embodiment, a separation projection 1*k* suspended downward is provided on a region between the connection portions 3*b* and 3*b* of the pair of left and right fixing contacts 3 and 3.

Figure 15:
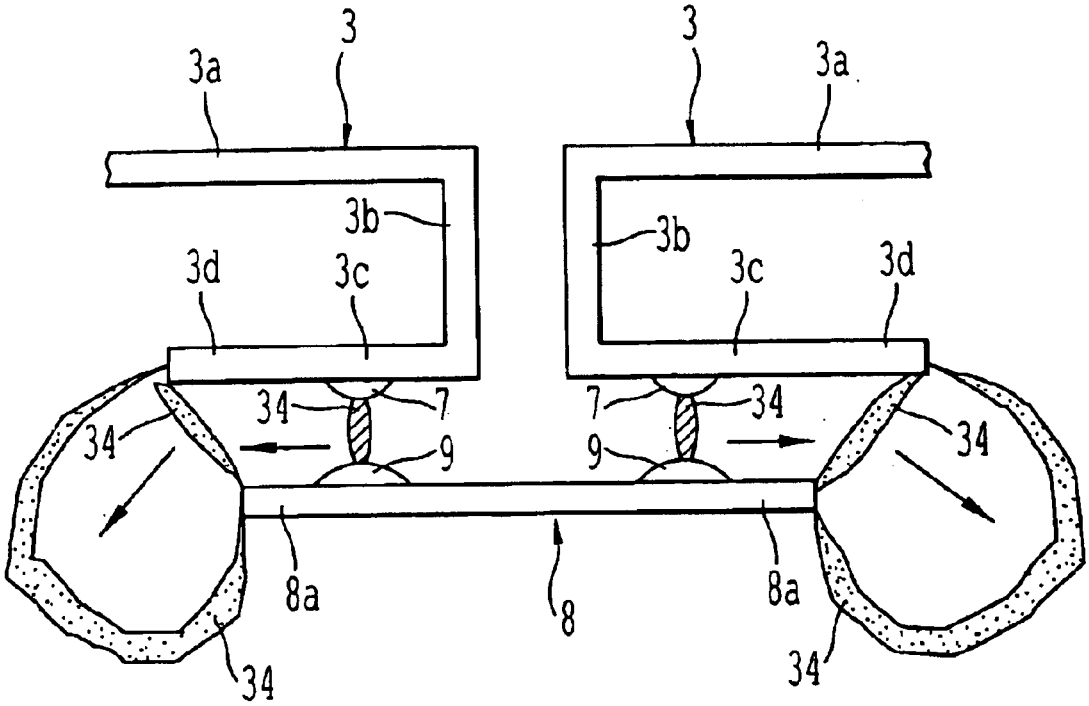
FIG. 15 is a schematic sectional view of an essential portion showing the action of the arc in the contact apparatus shown in FIG. 14.

In the contact apparatus of this structure, as shown in FIG. 15, the arc 34 generated between the contact points 7 and 9 when the electric path is opened moves sideways toward ends of the contact fixing portion 3*c* and the movable contact 8 by the magnetic force of the permanent magnet 32 like the previous embodiment. In this case, since the end of the contact fixing portion 3*c* is located outer side from the movable contact 8, when the arc 34 moved to a position between both the ends, the arc is inclined and becomes longer. Thereafter, the arc 34 is further curved and deformed, the arc length is further increased. As the arc 34 is stretched, the arc voltage abruptly rises and with this, the arc 34 is swiftly extinguished and the breaking is carried out at high speed.

In this embodiment, the lengths of the arc running portions 3*d* and 3*d* of the contact fixing portions 3*c* and 3*c* and the arc running portions 8*a* and 8*a* of the movable contact 8 are different from each other. Therefore, it is easy and swiftly to stretch the arc 34 in the process of movement of the arc 34, and the breaking characteristic of the electric path is further enhanced.

When arc running portion 3*d* of the contact fixing portion 3*c* is formed longer than the arc running portion 8*a* of the movable contact 8, the curved deformation of the arc 34 has directional property in diagonally downward direction. With this, air existing in the side space in the current switching chamber 12 is heated by the arc 34, and the pressure rises. The air (arc gas, hereinafter) whose pressure is increased also has directional property along the curved direction of the arc 34.

In this case, in the contact apparatus of this embodiment, as explained with reference to FIG. 14, the first partition wall 1*e* is not closed in the above direction and is in communication with the vent passage 1*j*. With this structure, the stretching space toward the above direction is secured. Therefore, the arc 34 can easily be stretched toward the vent passage 1*j*. Further, the arc gas flows toward the lower housing 1*b* from the current switching chamber 12 through the vent passage 1*j*.

A lower end of the vent passage 1*j* is in communication with outside through the outlet hole 1*g* through which the lead wire 40 is pulled out. The lower end is also in communication with the space in which the coil 14 is disposed through the notched opening 17*a* of the lower yoke 17. Thus, the space around the coil 14 is utilized as a space for releasing the arc gas. As a result, the pressure rise of the arc gas in the current switching chamber 12 is suppressed to a small value. With this structure, even if the housing 1 is substantially hermetically closed except the outlet hole 1*g*, the housing 1 is prevented from being swelled and deformed by the arc gas.

The contact apparatus is used for switching the DC current as described above, and the direction of the current is constant. However, in this kind of contact apparatus, a great current flows in the above direction, and small current flows in the opposite direction in some cases. A pair of left and right arcs generated between the contact points 7 and 9 when the current in the opposite direction flow move in a direction approaching each other by the magnet force of the permanent magnet 32 unlike the above explanation.

Figure 16:
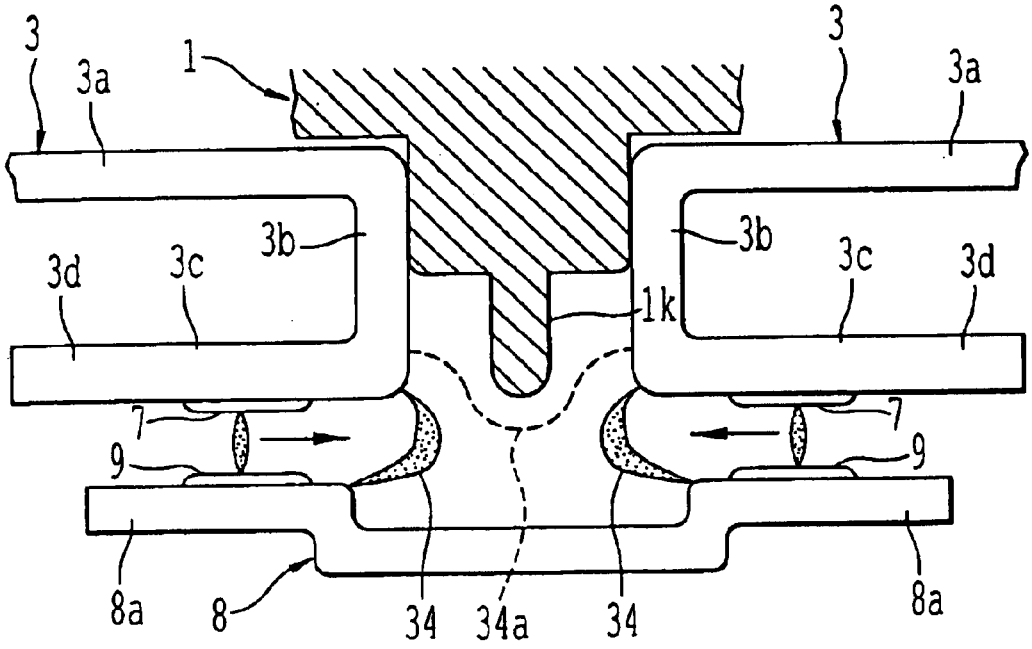
FIG. 16 is a schematic sectional view of an essential portion showing the action of the arc when current flows reversely in the contact apparatus shown in FIG. 14.

The separation projection 1*k* is provided between the fixing contacts 3 and 3 so that the arc is not kept and the electric path is reliably broken even in such a case also. That is, as shown in FIG. 16, if the arcs 34 and 34 generated in the contact points 7 and 9 move toward the center and curved such as to approach further, and if the arc 34 is changed to the arc 34*a* extending between the connection portions 3*b* and 3*b* of the fixing contacts 3 and 3, the arc 34*a* is stretched bypassing the separation projection 1*k*. Therefore, the arc voltage of such a shape becomes sufficiently high, the arcs 34 and 34 between the contact points 7 and 9 are extinguished to cut off the electric path.

The preferred embodiments of the present invention are explained above, the present invention is not limited to the embodiments except the scope of the invention, and the invention can variously be changed without departing from the spirit and scope of the invention.

For example, although the two permanent magnets 32 and 32 are opposed and disposed in parallel to each other in each of the embodiments, the invention is not limited to this structure only if the permanent magnets are disposed such that the magnetic field is formed at least between the contact points 7 and 9.

In the embodiments 1 and 2, the arc-extinguishing member 31 is formed into a rectangular parallelepiped box-like shape, the invention is not limited to this, and the arc-extinguishing member 31 may have only a surface perpendicular to the moving direction of the arc 34 between the contact points 7 and 9 for example.

The fixing contact 3 is of substantially U-shape in each of the above embodiments, the invention is not limited to this, and the fixing contact 3 may have any shape only if at least the fixing contact point 7 and the movable contact point 9 can be connected to and separated from each other.

In the embodiment 3, the arc running portion 3*d* of the fixing contact 3 is longer than the arc running portion 8*a* of the movable contact 8, the invention is not limited to this, and the arc running portion 8*a* of the movable contact 8 may be longer than the arc running portion 3*d* of the fixing contact 3.

The arc running portion 3*d* of the fixing contact 3 and the arc running portion 8*a* of the movable contact 8 in the embodiments 2 and 3 are in parallel to each other, the arc running portions 3*d* and 8*a* may not be in parallel such that they are separated from each other toward the end. In this case, since the arcs are stretched during the course of movement of the arc running portions 3*d* and 8*a*, the breaking characteristic is further enhanced.

Industrial Applicability

As described above, the contact apparatus of the present invention has excellent breaking characteristic of the electric path by providing the permanent magnet and the arc-extinguishing member. Therefore, the contact apparatus can preferably be used for an electromagnetic switching apparatus for opening and closing great DC current such as a power supply of an electrically running automobile, a power load relay and the like.

What is claimed is:

1. A contact apparatus comprising:

a fixed contact having a fixed contact point, a movable contact provided with a movable contact point which is connected to and separated from the fixed contact point, both the fixing contact and the movable contact providing running portions having different lengths with respect to the other, a driving mechanism for driving the movable contact, the driving mechanism having a permanent magnet disposed in a vicinity of a region where the fixed contact point and the movable contact point are located, an arc generated when the fixed contact point and the movable contact point are separated from each other is moved in a lateral direction with respect to the fixed contact point and movable contact point by magnetic force of the permanent magnet, and an arc-extinguishing member made of insulative material capable of generating arc-extinguishing gas is provided in a region near the fixed contact point and the movable contact point.

2. The contact apparatus according to claim 1, wherein the insulative material is unsaturated polyester.

3. The contact apparatus according to claim 1, wherein the insulative material is a chain compound to which metal hydroxide or hydrate is added.

4. The contact apparatus according to claim 3, wherein the chain compound is nylon 6 or nylon 66.

5. The contact apparatus according to claim 3, wherein the metal hydroxide is magnesium hydroxide.

6. The contact apparatus according to claim 1, wherein the arc-extinguishing member includes a slit in a region corresponding to a path of the arc movement.

7. The contact apparatus according to claim 1, wherein the arc-extinguishing member includes a metal plate in a region corresponding to a path of the arc movement.

8. The contact apparatus according to claim 1, wherein the arc-extinguishing member includes a projection in a region corresponding to a path of the arc movement.

9. The contact apparatus according to claim 1, wherein an end of the fixed contact point is formed into a substantially U-shape in which an end of a contact fixing portion to which a fixing contact point is mounted and an end of a terminal connection portion which is opposed to this contact fixing portion and is in substantially parallel to the contact fixing portion are connected to each other through a connection portion.

10. The contact apparatus according to claim 1, further comprising a yoke for mutually connecting the pair of permanent magnets magnetically.

11. The contact apparatus according to claim 10, wherein an end of the fixed contact point is formed into a substantially U-shape in which an end of a contact fixing portion to which a fixing contact point is mounted and an end of a terminal connection portion which is opposed to this contact fixing portion and is in substantially parallel to the contact fixing portion are connected to each other through a connection portion, and at least a portion of the yoke is disposed on the substantially U-shape portion of the fixing contact.

12. The contact apparatus according to claim 10, wherein the yoke comprises two yoke parts each having L-shaped section.

13. The contact apparatus according to claim 12, wherein the two yoke parts are held by suction force of the permanent magnet.

14. The contact apparatus according to claim 1, wherein at least one of the fixing contact and the movable contact having an arc running portion extending in a direction in which the arc is moved by the force of the permanent magnet.

15. The contact apparatus according to claim 1, further comprising:

a housing having a first partition wall for partitioning the driving mechanism from a current switching chamber in which the fixing contact point and the movable contact point are located, a second partition wall is provided in a region between the driving mechanism at a location closer to the driving mechanism than the first partition wall and an outer wall of the housing, and a vent passage which extends to the current switching chamber is formed between the second partition wall and the outer wall of the housing.

16. The contact apparatus according to claim 1, wherein a pair of fixing contacts are disposed such as to be opposed to opposite ends of the movable contact, movable contact points respectively provided on opposite ends of the movable contact are connected to and separated from a fixing contact points provided on each of the fixing contact, a housing is provided a region between both the fixing contacts with a separation projection for spreading the arc when the arc is generated between both the fixing contacts.

* * * * *